US006581680B1

(12) United States Patent
Wentworth

(10) Patent No.: US 6,581,680 B1
(45) Date of Patent: Jun. 24, 2003

(54) APPARATUS FOR MOUNTING AN ELECTRONIC DEVICE FOR USE IN DIRECTIONAL DRILLING

(75) Inventor: Steven W. Wentworth, Brookfield, WI (US)

(73) Assignee: Earth Tool Company, L.L.C., Oconomowoc, WI (US)

( * ) Notice: Subject to any disclaimer, the term of this patent is extended or adjusted under 35 U.S.C. 154(b) by 0 days.

(21) Appl. No.: 10/061,068

(22) Filed: Jan. 29, 2002

Related U.S. Application Data

(62) Division of application No. 09/465,479, filed on Dec. 16, 1999, now Pat. No. 6,422,782.

(51) Int. Cl.[7] ..... E21B 47/12

(52) U.S. Cl. ..... 166/65.1; 166/250.01; 175/45

(58) Field of Search ..... 166/65.1, 250.01, 166/378, 66.7; 175/45, 398, 50

(56) References Cited

U.S. PATENT DOCUMENTS

| | | | | |
|---|---|---|---|---|
| 4,907,658 A | | 3/1990 | Stangl et al. | 175/19 |
| 5,148,880 A | | 9/1992 | Lee et al. | 175/393 |
| 5,251,708 A | * | 10/1993 | Perry et al. | 175/41 |
| 5,253,721 A | | 10/1993 | Lee | 175/73 |
| 5,475,187 A | * | 12/1995 | Omnes | 181/102 |
| 5,633,589 A | | 5/1997 | Mercer | 324/326 |
| 5,647,448 A | | 7/1997 | Skaggs | 175/421 |
| 5,778,991 A | | 7/1998 | Runquist et al. | 175/61 |
| 5,795,991 A | | 8/1998 | Hesse et al. | 73/12.09 |
| 5,799,740 A | | 9/1998 | Stephenson et al. | 175/62 |
| 5,855,347 A | * | 1/1999 | Hollingsworth et al. | 248/220.41 |
| 5,899,283 A | | 5/1999 | Cox | 175/376 |
| 5,934,391 A | | 8/1999 | Cox | 175/73 |
| 5,975,222 A | * | 11/1999 | Holte | 175/273 |

OTHER PUBLICATIONS

Vermeer Navigator Boring Tools Parts Manual, Vermeer Manufacturing Company, 1994, pp. 3–1 and 2–4.

Vermeer Directional Boring Accessories, Vermeer Manufacturing Company, 1997. 4 pages.

Vermeer Navigator Boring Tools Parts Manual, Vermeer Manufacturing Company, 1996, pp. 2–1–2–16.

Spirol Coiled Pins brochure, Spirol International Corporation, Feb., 1997, 14 pages.

* cited by examiner

*Primary Examiner*—Frank Tsay
(74) *Attorney, Agent, or Firm*—Philip G. Meyers

(57) ABSTRACT

The present invention provides an improved apparatus for mounting an electronic device such as a sonde therein for use in directional drilling. Such an apparatus includes an elongated housing having projections at opposite ends of the housing for connecting the housing to other components of the boring machine, an elongated internal chamber configured to receive an electronic device therein and having an elongated access opening which extends along an exterior surface of the housing, and a cover sized to close the access opening, the cover having a first hole extending therethrough. The housing includes a second hole which comes into alignment with the first hole when the cover is in a position to close the access opening, and has a third hole at least partially intersecting the second hole, whereby when a pin having a head for holding down the cover is inserted in the first and second holes, a retainer such as a roll pin for engaging the pin may be inserted in the third hole in a manner effective to engage the pin so that the pin holds down the cover. According to preferred form of the invention, the pin preferably has an enlarged diameter head which seats against a step in the first hole to hold down the cover, and a concave groove that comes into alignment with a round interior surface of the third hole when the pin is fully inserted so that the head engages the step. The retainer can then extend into the concave groove in the pin to prevent removal of the pin from the first and second holes. A side load sonde housing according to the invention has improved strength yet remains easy to open and close.

10 Claims, 4 Drawing Sheets

APPARATUS FOR MOUNTING AN ELECTRONIC DEVICE FOR USE IN DIRECTIONAL DRILLING

RELATED APPLICATION

This is a divisional of application Ser. No. 09/465,479, filed Dec. 16, 1999, U.S. Pat. No. 6,422,782, issued Jul. 23, 2002.

TECHNICAL FIELD

The invention relates to directional boring machines that use an onboard sonde for controlling the direction of the bore.

BACKGROUND OF THE INVENTION

Directional boring machines or trenchless drills for making holes through soil are well known. The directional borer generally includes a series of drill rods joined end to end to form a drill string. The drill string is pushed or pulled though the soil by means of a powerful device such as a hydraulic cylinder. A spade, bit or head having one or more angled faces configured for boring is disposed at the end of the drill string and may include an ejection nozzle for water or drilling mud to assist in boring.

In one known directional boring system, the drill bit is pushed through the soil without rotation in order to steer the tool by means of the angled face, which is typically a forwardly facing sloped surface. For rocky conditions, a row of teeth may be added to the drill bit and the bit operated in the manner described in Runquist et al. U.S. Pat. No. 5,778,991. Other toothed bits for directional boring through rock are shown in Cox U.S. Pat. No. 5,899,283, Skaggs U.S. Pat. No. 5,647,448 and Stephenson U.S. Pat. No. 5,799,740. Steering systems for use with these devices require keeping track of the angle of rotation of the sloped face of the bit and/or the teeth.

According to another known system, a transmitter or sonde mounted in a tubular housing is mounted behind and adjacent to the bit and sends a signal that indicates the angle of rotation of the bit. The sonde is mounted in a predetermined alignment relative to the steering portion of the bit. Since the sonde housing is generally made of steel, a series of longitudinal slots or windows are provided through the wall of the sonde housing to permit transmission of the signal. See generally Mercer U.S. Pat. No. 5,633,589, Hesse et al. U.S. Pat. No. 5,795,991, and Stangl et al. U.S. Pat. No. 4,907,658. Mounting of the sonde in its housing has been accomplished by end loading as illustrated by the foregoing patent to Stangl et al. or through a side opening which is closed by a door or cover during use, as illustrated in Lee et al. U.S. Pat. Nos. 5,148,880 and 5,253,721.

Prior attempts to use sondes in horizontal directional boring apparatus, particularly of the type for drilling consolidated rock formations, have proven less than ideal. Breakage of the sonde is to be avoided because sondes are expensive to replace. The sonde housing cover in side-loading sonde housings is prone to failure. The bolts used to secure the cover often loosen or break off as a result of the abrasion and stress applied to the sonde housing during boring, and the door or cover may work loose or collapse inwardly, crushing the sonde. A need remains for a more secure side-loading sonde housing which is nonetheless easy to open and close when necessary. The present invention addresses these concerns.

SUMMARY OF THE INVENTION

The present invention provides an improved apparatus for mounting an electronic device such as a sonde therein for use in directional drilling. Such an apparatus includes an elongated housing having projections at opposite ends of the housing for connecting the housing to other components of the boring machine and an elongated internal chamber configured to receive an electronic device therein. The chamber has an elongated access opening which extends along an exterior surface of the housing. A cover sized to close the access opening has a first hole extending therethrough. The housing includes a second hole which comes into alignment with the first hole when the cover is in position to close the access opening, and a third hole at least partially intersecting the second hole. When a pin having a head for holding down the cover is inserted in the first and second holes, a retainer such as a roll pin for engaging the pin may be inserted into the third hole in a manner effective to mechanically engage the pin so that the pin holds down the cover. According to preferred form of the invention, the pin preferably has an enlarged diameter head which seats against a step in the first hole to hold down the cover, and a groove that comes into alignment with an interior surface of the third hole when the pin is fully inserted so that the head of the pin engages the step. The retainer can then extend into the groove in the pin to prevent removal of the pin from the first and second holes. Preferably both the groove and the third hole have a circular profile so that an elongated, cylindrical retainer can fit therein.

According to a second aspect of the invention, a pin adapted for holding down a sonde housing cover comprises an elongated, generally cylindrical rod made of a rigid, hard material and having an enlarged diameter head. A concave groove is formed on the rod at a location spaced from the head along the length of the rod, and a button of a material harder than the rod material is centrally mounted on top of the head. The button is effective for inhibiting flattening of the head by hammering thereon during installation. The annular groove preferably has a circular profile in the lengthwise direction of the pin so that precise location of the pin relative to the retainer is not necessary.

According to a third aspect of the invention, a joint for coupling a pair of elongated members end to end includes a projection extending in a lengthwise direction from one end of one of the elongated members and a socket in an end of the other of the elongated members, which socket is sized to slidingly receive the projection. A first set of alignable transverse holes are formed in the projection and in a wall defining the socket, which openings are configured to receive a removable pin for mechanically interlocking the projection in the socket. A second set of alignable transverse holes formed in the projection and in a wall defining the socket are configured to receive a removable retainer for mechanically interlocking the pin in the first set of alignable transverse holes. In a manner analogous to the first aspect of the invention, the second set of alignable transverse holes at least partially intersects the first set of alignable transverse holes, whereby when a pin is inserted in the first set of holes, a retainer for engaging the pin may be inserted in the second set of holes in a manner effective to engage the pin so that the pin remains in the first set of alignable transverse holes. These and other aspects of the invention are described in detail below.

BRIEF DESCRIPTION OF THE DRAWINGS

In the accompanying drawings, wherein like numerals denote like elements:

FIG. 6 is cross sectional view taken along the line 6—6 in. FIG. 4;

Figure 1:
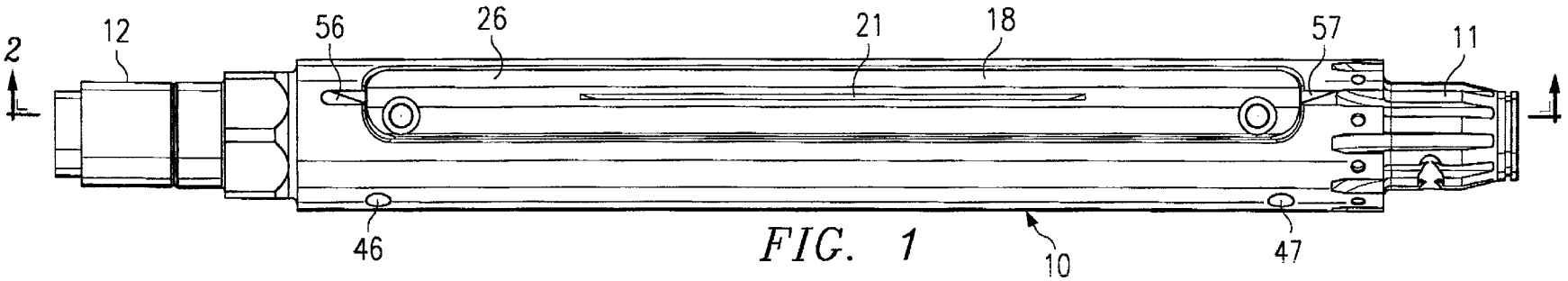
FIG. 1 is a top, angled view of sonde housing according to the invention.

While the making and using of various embodiments of the present invention are discussed in detail below, it should be appreciated that the present invention provides many applicable inventive concepts which can be embodied in a wide variety of contexts. The embodiments discussed herein are merely illustrative of specific ways to make and use the invention and do not limit the scope of the invention.

DETAILED DESCRIPTION

Referring now to FIGS. 1 to 9, a sonde housing 10 according to the invention is configured for use in a directional drilling apparatus as part of a drill head. A splined front end projection 11 permits a drill bit to be mounted on the front end of housing 10, and a rear end projection 12 is configured for connection to a starter rod at the terminal end of a drill string. For this purpose, projections 11, 12 may act as either the male or female portion of the resulting joint or coupling, and any desired end connection configuration can be employed. An internal flow passage 16 extends along the length of housing 10 in order to conduct drilling mud or water to a connecting passage in the bit. These drill head features are preferably as described in co-pending, commonly assigned U.S. Pat. No. 6,263,983, issued Jul. 24, 2001 and PCT International Application No. US99/19331, filed Aug. 24, 1999, which applications are incorporated by reference herein for all purposes.

Sonde housing 10 has a lengthwise, laterally-opening sonde cavity 17 which is closed in use by a removable cover 18. Cavity 17 has a centered, rearwardly-facing L-shaped key 19 which engages a corresponding groove in the end of the conventional cylindrical sonde to securely position the sonde in the cavity 17 in a predetermined alignment relative to the cutting teeth of the bit. Since housing 10 is made of steel, a series of spaced, thin longitudinal slots 21 are provided in housing 10 and cover 18 so that the signal from the sonde can be detected from the ground surface.

Figure 2:
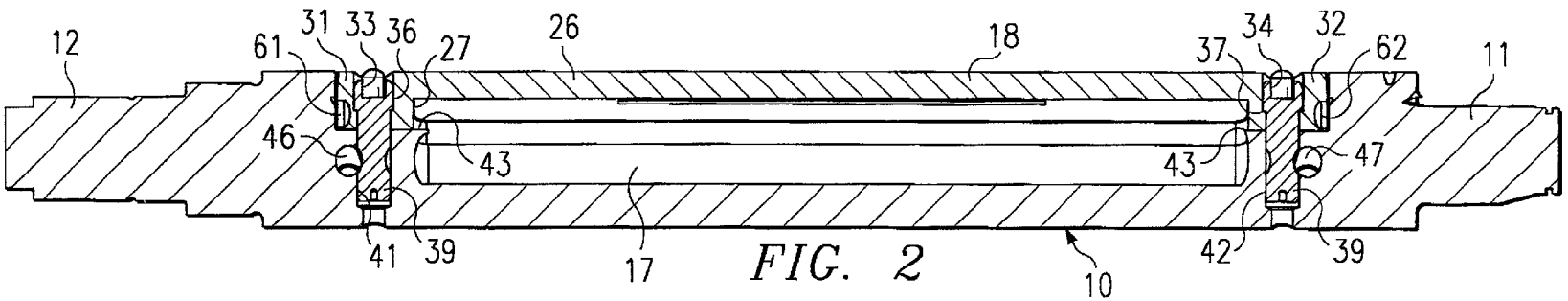
FIG. 2 is a lengthwise sectional view of along the line 2—2 in FIG. 1.
Figure 8:
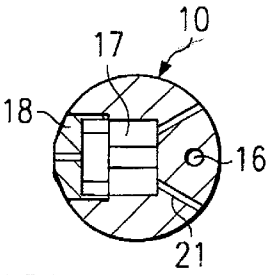
FIG. 8 is cross sectional view taken along the line 8—8 in FIG. 4.
Figure 7:
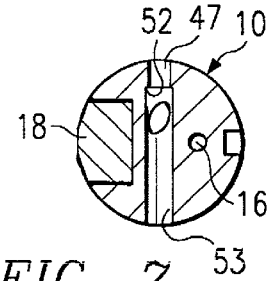
FIG. 7 is cross sectional view taken along the line 7—7 in FIG. 4.
Figure 6:
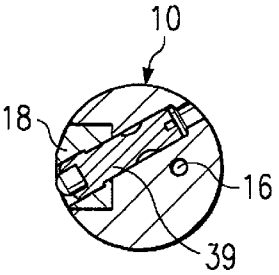
Figure 3:
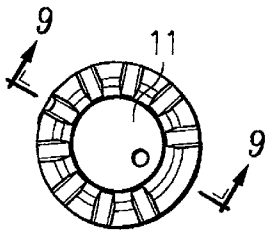
FIG. 3 is a front end view of the sonde housing shown in FIG. 1.
Figure 5:
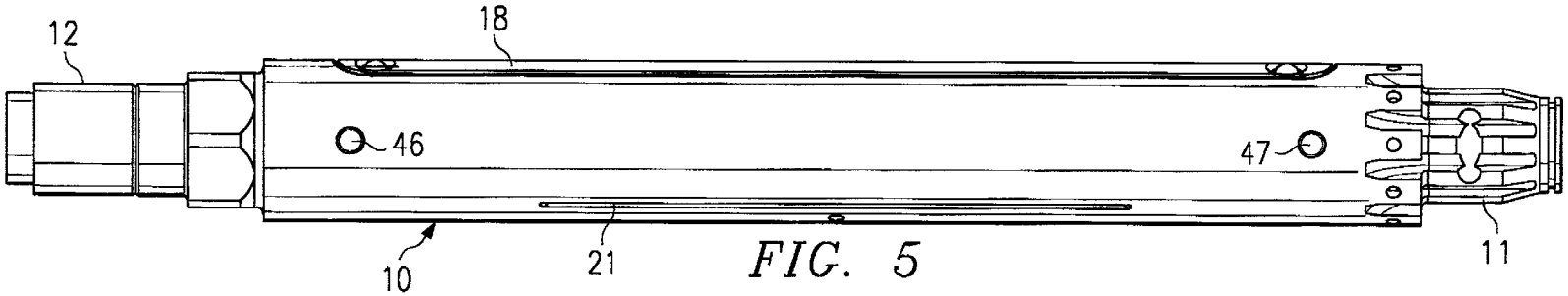
FIG. 5 is a side view of the sonde housing of FIG. 4.
Figure 9:
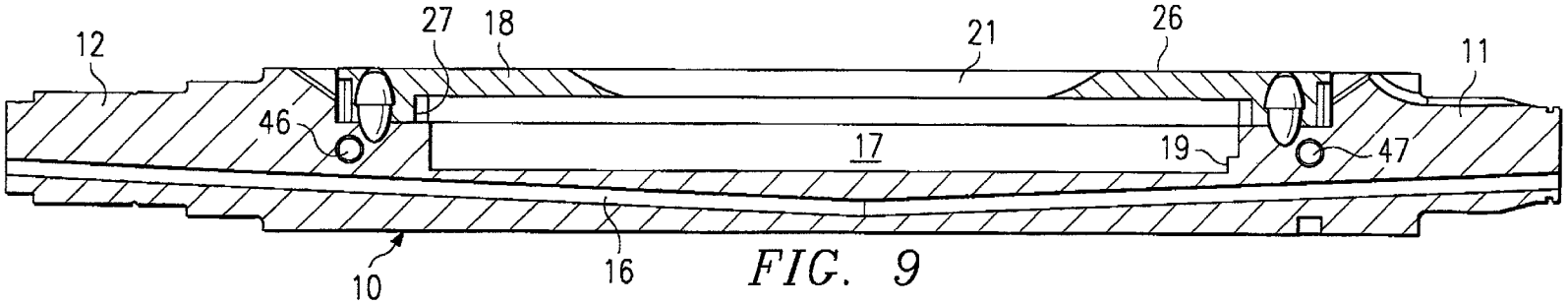
FIG. 9 is a lengthwise sectional view of along the line 9—9 in FIG. 3.
Figure 10:
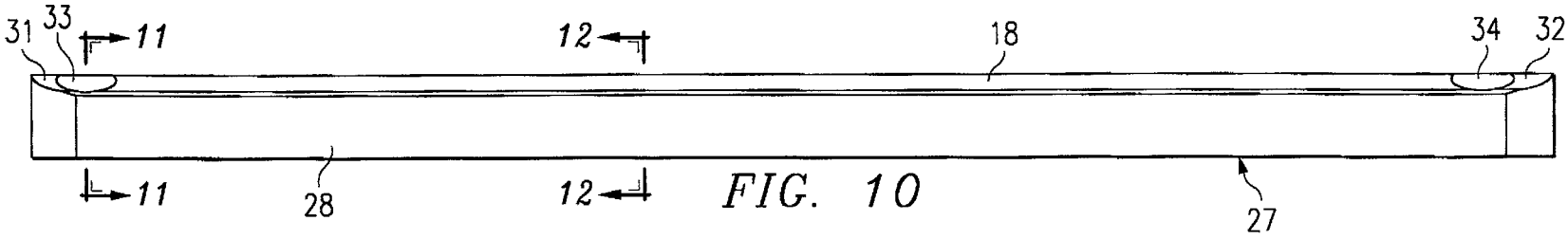
FIG. 10 is a side view of the cover shown in FIG. 1.
Figure 13:
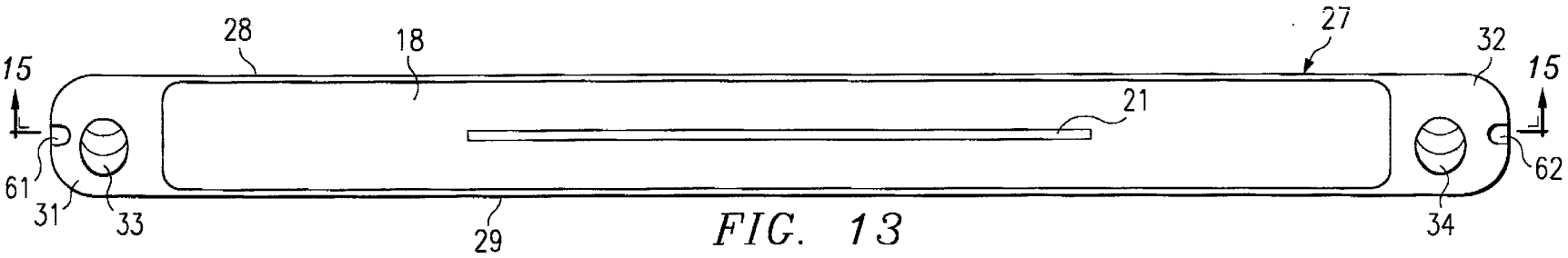
FIG. 13 is a bottom view of the cover of FIG. 10.
Figure 15:
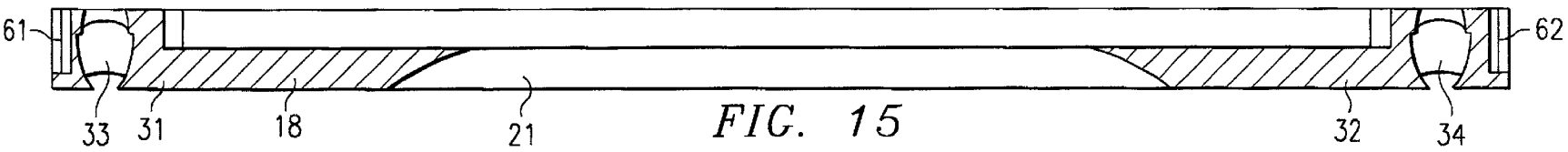
FIG. 15 is a lengthwise sectional view of along the line 15—15 in FIG. 13.
Figure 14:
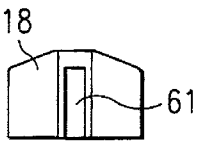
FIG. 14 is a front end view of the cover shown in FIG. 10.
Figure 12:
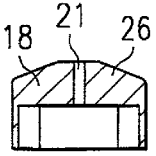
FIG. 12 is a cross sectional view of along the line 12—12 in FIG. 10.
Figure 11:
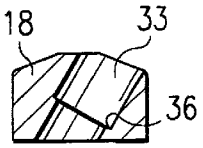
FIG. 11 is a cross sectional view of along the line 11—11 in FIG. 10.

Unlike prior sonde doors or covers, which are generally flat plates with or without tabs or projections to assist in retaining the door, cover 18 as shown in FIGS. 10–15 has an inverted trough-shape, with a top wall 26 and a generally rectangular flange 27 that extends downwardly (as shown in FIGS. 2 and 9) and perpendicularly relative to top wall 26. Flange 27 includes a pair of thin, elongated side walls 28, 29 which span a pair of front and rear end portions 31, 32. Cavity 17 is interposed between end portions 31, 32 as shown. Top wall 26 may be flat, but is preferably arcuate or approximately arcuate (see FIG. 12) so that it has a similar cross-sectional shape to the round housing 10 as seen in FIGS. 6–8.

A pair of parallel, angled first holes 33, 34 extend through the thickness of end portions 31 and 32, respectively. Holes 33, 34 have outwardly facing annular steps 36, 37 therein for engaging the enlarged diameter heads 38 of a pair of cover retaining pins 39. Housing 10 has a pair of second holes 41, 42 therein which are configured to come into alignment with holes 33, 34, respectively, when cover 18 is fully inserted so that flange 27 engages a raised rim 43 of sonde cavity 17 (see FIG. 2). Pins 39 fit into aligned pairs of holes 33, 41 and 34, 42. Housing 10 further has a pair of third, pin retainer holes 46, 47 which intersect holes 41, 42 respectively at an angle which may be a right angle or an acute included angle as shown. The respective axes of holes 41, 46 and 42, 47 are slightly offset and do not intersect, resulting in partial overlap. The angle at which holes 33, 34 and 41, 42 extend relative to the radial direction of the sonde housing is selected to avoid fluid passage 16. If passage 16 is relocated, holes 33, 34 and 41, 42 could be oriented in the radial direction of the sonde housing, i.e., perpendicular to top surface 26 of cover 18.

Figure 16:
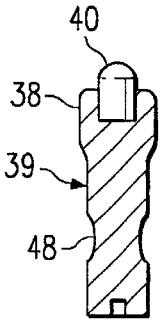
FIG. 16 is a lengthwise sectional view of a preferred pin according to the invention.

As best shown in FIG. 16, pins 39 lack the external threads used on prior art retaining bolts. An annular groove 48 that is concave, preferably having a circular profile in the lengthwise direction of pin 39, is formed along the middle of each pin 39 at a location spaced from head 38. As shown in FIG. 2, the curvature of groove 48 in each pin 39 preferably matches the curvature of holes 46, 47 and comes into alignment therewith when pin 39 is fully inserted. Retainers 51 such as roll pins may then be inserted into holes 46, 47 after pins 39 have been filly inserted in holes 41, 42 so that retainers 51 engage annular grooves 48. Grooves 48 are advantageous in that precise alignment of pins 39 within holes 41, 42 is not required, and grooves 48 do not significantly weaken pins 39. However, other arrangements can be used, such as providing a radial through-hole in pin 39 such that the axes of holes 41, 42 intersect with the axes of holes 46, 47, respectively.

Retainers 51, when fully inserted from wide end 53 of holes 46, 47, engage a step 52 in holes 46, 47 when fully inserted. Retainers 51 are preferably compressed during installation from a relaxed state diameter slightly larger than the associated hole diameter to a retaining diameter at which an outer circumferential surface of the retainer tightly engages inner surfaces of the openings. For this purpose, retainers 51 preferably are spiral-wound roll pins such as Spirol brand roll pins, or one or a series of nested, split (C-) rings of the type which resiliently engage the walls of a mounting hole once inserted. A high-strength plastic rod, tubular or solid, could also be used for retainer 51. By contrast, pins 39 are most preferably substantially solid, as opposed to tubular, and made of a high-strength, high-rigidity material such as steel. In general, pins 39 should be stronger than retainers 51 because pins 39 bear the load of holding down cover 18, whereas retainers 51 need only be strong enough to resist disengagement of pins 39. Since pins 39 will be pounded into place with a hammer, it is preferred to provide a carbide button 40 protruding from the top center of head 38. Button 40 may be brazed or welded into a recess in head 38, and prevents head 38 from flattening and widening under hammer blows, which could cause pin 39 to become jammed in hole 33 or 34.

Figure 4:
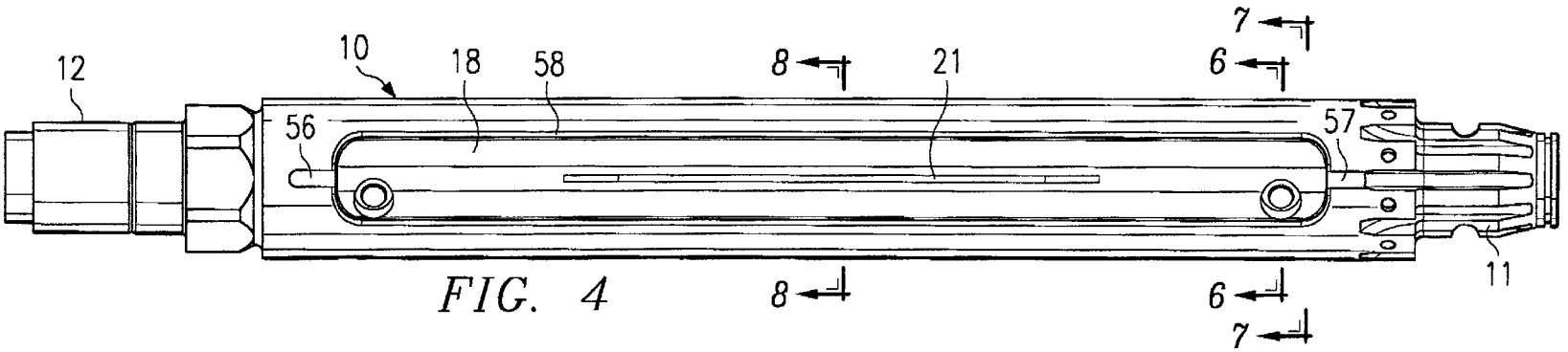
FIG. 4 is a top view of the sonde housing of FIG. 1.

Retainers 51 can be readily removed and inserted manually with a hammer and chisel. Once retainers 51 are disengaged from pins 39, cover 18 and pins 39 can be removed by inserting a tool into one or both of central end slots 56, 57 provided at opposite ends of a rim 58 of cavity 17 (FIG. 4). Cover 18 has a pair of shallow, outwardly opening recesses 61, 62 at opposite ends thereof which come into alignment with slots 56, 57 respectively when cover 18 is fully inserted into cavity 17. A lever inserted into recess 61 or 62 through slot 56 or 57 can be used to pry cover 18 out of cavity 17 by its end(s). Once the sonde or sonde battery has been replaced, cover 18 can be reinserted to re-close cavity 17.

The foregoing sonde housing structure has a number of advantages over existing designs that rely on tabs or projections to retain the cover. Flange 27, which engages raised rim 43 of sonde cavity 17, ensures that cover 18 will collapse inwardly, crushing the sonde. The lack of tabs and wide recesses on the outside of the sonde housing, such as those shown in the above-cited PCT International Application No. US99/19331, filed Aug. 24, 1999, presents fewer external housing edges that are susceptible to wear. Cover 18 may also be installed and removed directly without having to slide it laterally into and out of position.

Figure 18:
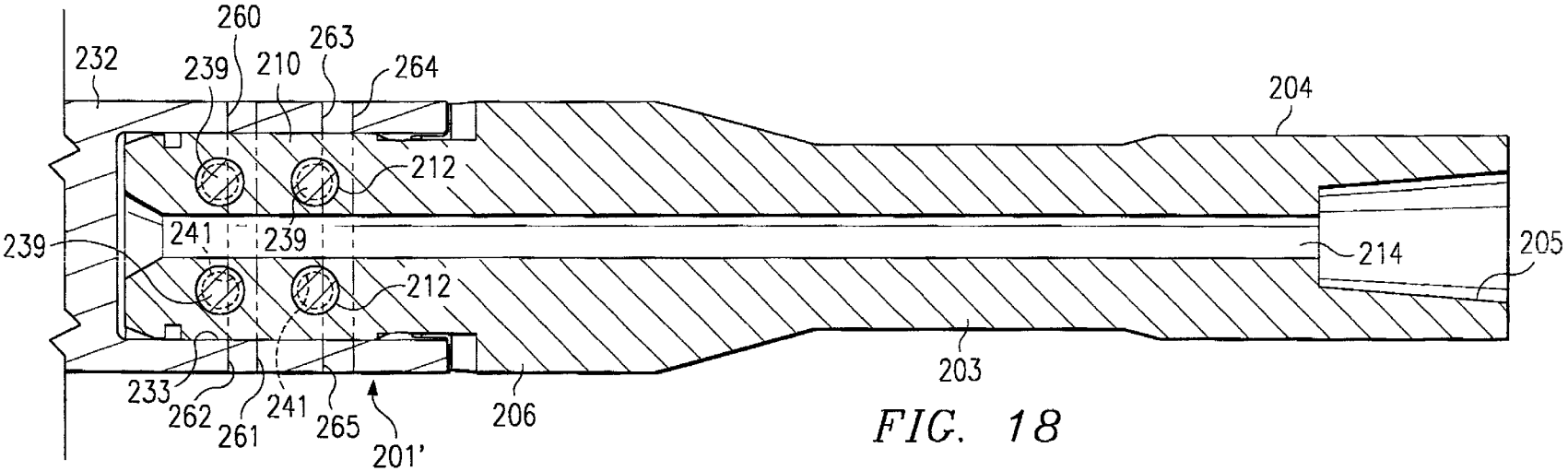
FIG. 18 is a lengthwise sectional view of an improved joint according to the invention.
Figure 20:
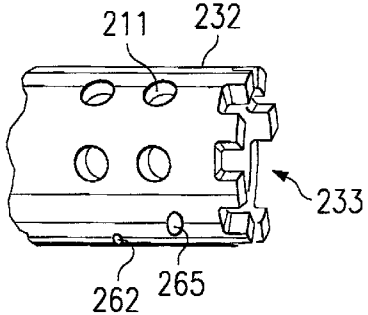
FIG. 20 is a partial, perspective view of the sonde housing shown in FIG. 19.

The foregoing two-pin mechanism of the invention may also be used in other contexts, such as the joint described in the above-cited PCT International Application No. US99/19331, filed Aug. 24, 1999. For example, referring to FIG. 18 showing a joint 201' between a starter rod 203 and sonde housing 232, a cylindrical projection 210 coaxial with a lengthwise axis of starter rod 203 extends from a enlarged diameter front end portion 206 of starter rod 203. Projection 210 has four transverse holes 212 extending therethrough at spaced positions, preferably offset from the lengthwise axis of starter rod 203 as shown. Projection 210 is slidingly insertable into a rearwardly opening socket 233 in sonde housing 232. The tubular rear wall of housing 232 has four pairs of opposed, elongated, cylindrical through-holes 211 which are brought into alignment with holes 212 when projection 210 is fully inserted into socket 232, with or without use of torque-passing splines as part of the joint.

Figure 19:
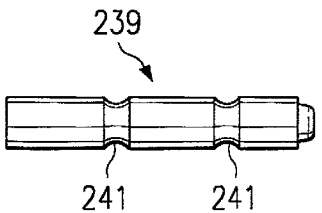
FIG. 19 is a side view of a pin for use in the improved joint of FIG. 18.
Figure 17:
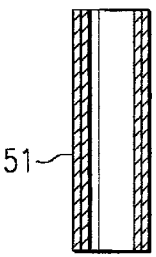
FIG. 17 is a lengthwise sectional view of a preferred pin retainer according to the invention.

Solid pins 239 similar to pins 39 (but without need for widened heads 38 or carbides 40) are inserted into holes 212 and the aligned holes in the sonde housing wall to secure the joint 201'. Annular concave grooves 241 of such pins 239 are engaged by retainers 51 inserted in a pair of sets of aligned transverse holes 260, 261, 262 and 263, 264, 265 shown in phantom lines. One or more of holes 260, 262, 263 or 265 may be stepped if needed to prevent over-insertion of retainers 51. Sets of aligned transverse holes 260, 261, 262 and 263, 264, 265 are preferably staggered so that one is above and other below the common lengthwise axis of sonde housing 232 and starter rod 203 when viewing the assembly from the side, with holes 212 oriented vertically. For this purpose, pins 239 may be configured as shown in FIG. 19 with a pair of spaced, annular, concave recesses 241 positioned so that one of recesses 241 will be in the correct position regardless of which end of the pin is inserted first. Such an arrangement provides improved joint strength, since pins 239 are much better able to withstand high loads than hollow roll pins, and may eliminate the need to provide torque-passing splines.

While certain embodiments of the invention have been illustrated for the purposes of this disclosure, numerous changes in the method and apparatus of the invention presented herein may be made by those skilled in the art, such changes being embodied within the scope and spirit of the present invention as defined in the appended claims.

What is claimed is:

1. An apparatus for mounting an electronic device therein, for use in directional drilling, comprising:

an elongated housing having connecting projections at opposite ends of the housing and an elongated internal chamber configured to receive an electronic device therein and having an elongated access opening which extends along an exterior surface of the housing; and a cover sized to close the access opening, the cover having a first hole extending therethrough, and wherein the housing includes a second hole which comes into alignment with the first hole when the cover is in a position to close the access opening, and has a third hole at least partially intersecting the second hole, whereby when a pin having a head for holding down the cover is inserted in the first and second holes, and a retainer may be inserted in the third hole in a manner effective to engage the pin so that the pin holds down the cover.

2. The apparatus of claim 1, further comprising the pin and the retainer.

3. The apparatus of claim 2, wherein the pin has an enlarged diameter head which seats against a step in the first hole to hold down the cover.

4. The apparatus of claim 3, wherein the pin has a concave groove therein which comes into alignment with a round interior surface of the third hole when the pin is fully inserted so that the head engages the step, whereby the retainer extends into the concave groove in the pin to prevent removal of the pin from the first and second holes.

5. The apparatus of claim 4, wherein the retainer resiliently engages the round interior surface of the third hole.

6. The apparatus of claim 5, wherein the retainer comprises a roll pin.

7. The apparatus of claim 4, wherein the concave groove comprises an annular groove having a circular profile in the lengthwise direction of the pin.

8. A pin adapted for holding down a sonde housing cover, comprising an elongated, generally cylindrical rod made of a rigid, hard material and having an enlarged diameter head, a concave groove at a location spaced from the head along the length of the rod, and a button of a material harder than the rod material centrally mounted on top of the head and effective for inhibiting flattening of the head by hammering thereon.

9. The pin of claim 8, wherein the button is a rounded carbide stud set into a hole in the head.

10. The pin of claim 8, wherein the concave groove comprises an annular groove having a circular profile in the lengthwise direction of the pin.

* * * * *